US005577400A

United States Patent [19]

Palange

[11] Patent Number: 5,577,400

[45] Date of Patent: Nov. 26, 1996

[54] KNITTING APPARATUS AND METHOD

[76] Inventor: Walter Palange, Via Cuostile 5-7, Gaeta (LT), Italy, 04024

[21] Appl. No.: 569,586

[22] Filed: Dec. 8, 1995

Related U.S. Application Data

[63] Continuation of Ser. No. 303,997, Sep. 9, 1994.

[30] Foreign Application Priority Data

Sep. 9, 1993 [IT] Italy ..... LT93A0008

[51] Int. Cl.[6] ..... D04B 3/00

[52] U.S. Cl. ..... 66/4

[58] Field of Search ..... 66/1 A, 1 R, 3, 66/4

[56] References Cited

U.S. PATENT DOCUMENTS

| | | | |
|---|---|---|---|
| 44,568 | 10/1864 | Wallis . | |
| 136,480 | 3/1873 | Armour | 66/3 X |
| 1,286,349 | 12/1918 | Kopp . | |
| 2,134,066 | 10/1938 | Van Ness | 66/4 |
| 2,138,108 | 11/1938 | Lapham | 112/1 |
| 2,318,018 | 5/1943 | Semonsen | 66/4 |
| 2,457,064 | 12/1948 | Parisi | 66/4 |
| 2,539,479 | 1/1951 | Robertson | 6/1 A |
| 2,603,957 | 7/1952 | Brooks | 66/1 A |
| 3,143,868 | 8/1964 | Palange | 66/1 A |
| 4,193,273 | 3/1980 | Palange | 66/4 |
| 4,246,768 | 1/1981 | Palange | 66/4 |
| 4,362,032 | 12/1982 | Palange | 66/4 |
| 4,603,560 | 8/1986 | Pietrowski | 66/1 R |

FOREIGN PATENT DOCUMENTS

| | | | |
|---|---|---|---|
| 1397982 | 3/1965 | France . | |
| 136019 | 9/1901 | Germany . | |
| 204750 | 12/1908 | Germany . | |
| 512393 | 11/1930 | Germany . | |
| 521894 | 3/1931 | Germany . | |
| 295972 | 4/1952 | Germany | 66/4 |
| 1076305 | 2/1960 | Germany | 66/86 M |
| 2128075 | 12/1972 | Germany . | |
| 310922 | 12/1932 | Italy . | |
| 5019655 | 7/1975 | Japan . | |
| 257093 | 3/1949 | Switzerland . | |
| 174692 | 10/1952 | Switzerland . | |
| 752404 | 7/1956 | United Kingdom | 66/4 |

*Primary Examiner*—John J. Calvert
*Attorney, Agent, or Firm*—Dinsmore & Shohl P.L.L.

[57] ABSTRACT

An improved knitting assembly for producing patterned knitted fabric includes a needle assembly having a handle portion and a plurality of needle tips associated with the handle portion and arranged in a spaced, selectively determined order. At least one of the needle tips has predetermined and distinct operational and nonoperational positions, whereby the order of the needles may be effectively reconfigured by selectively positioning the needle tips in desired operational or nonoperational positions. The assembly further preferably includes a plurality of detachably connected independent handle portions, and the order of needle tips may be changed by detaching the handle portions, rearranging the handle portions, and reattaching the handle portions in the new order.

The knitting assembly also preferably includes a hook assembly for creating purl stitches. The hook assembly includes at least one handle portion and a plurality of hook tips, wherein the order of the hook tips may be rearranged in the same manner as the needle tips of the needle assembly. Stitches and patterns are created with this assembly that were previously difficult or impossible to create with manual knitting apparatus.

19 Claims, 6 Drawing Sheets

KNITTING APPARATUS AND METHOD

This a divisional, of application Ser. No. 08/303,997, filed Sep. 9, 1994.

TECHNICAL FIELD

This invention relates to an apparatus, an assembly, a system, and a method for manual knitting, and more particularly, to an improved device and method for manual knitting of diverse types of knit fabrics, wherein a greater variety

BACKGROUND ART

Garments made out of knit fabrics are extremely popular consumer items, especially garments such as heavy sweaters which have intricate designs and patterns. However, garments such as elaborate sweaters and the like are, for many people, prohibitively expensive to purchase. In order to more easily afford these items, and often for enjoyment as a hobby, people often opt to make their own knitted garments. Unfortunately, traditional manual knitting using a pair of standard knitting needles is a complicated process and can be extremely difficult to learn well. In addition, manual knitting with a traditional pair of needles is extremely time consuming, because the fabric is created one stitch at a time, and even a simple knitted garment is constructed of thousands of stitches. Creating intricate designs by traditional knitting methods is extremely tedious, as only one color of yarn may be stitched at a time. Moreover, traditional hand knitting can be difficult and uncomfortable, or even impossible, for people (especially elderly people) whose eyes are easily strained or whose hands are susceptible to pain and swelling such as from arthritis or other afflictions, which may be exacerbated by manipulation of the needles and yarn.

In response to these problems, attempts have been made to create inexpensive manual knitting assemblies which simplify the traditional manual knitting process; however, knitting with these known manual devices may still be a slow process, and the variety of stitches that may be made is limited in comparison to traditional knitting needles. Thus, there is a significant need for an improved manual knitting apparatus that allows a user to more easily and conveniently make more varieties of stitches and intricate designs at a faster pace.

SUMMARY OF THE INVENTION

It is a primary object of the present invention to obviate the above-described problems and shortcomings of manual knitting assemblies and methods previously and currently available in the industry.

It is another object of the present invention to provide improved manual knitting assemblies which have simple and economical constructions.

It is yet another object of the present invention to provide improved manual knitting assemblies which can be used with a minimum of instruction to perform diverse types of knitting operations and produce a variety of different It is a further object of the present invention to provide improved manual knitting assemblies and methods with which knit fabrics can be quickly made.

It is still another object of the present invention to provide improved manual knitting assemblies and methods which are less tedious and stressful on a person's eyes and hands.

It is still a further object of the present invention to provide improved manual knitting assemblies and methods that employ multiple needles which are selectively arranged in a distinct order so that different patterns may be made in the fabric in accordance with the order of the needles being used.

It is yet another object of the present invention to provide an improved manual knitting apparatus and method that utilizes different types of interchangeable needles for creating different types of stitches.

Additional objects, advantages, and other novel features of the invention will be set forth in part in the description that follows, and in part, will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention disclosed herein, an improved knitting assembly is provided for use with a knitting apparatus for producing patterned knitted fabric. The knitting assembly comprises a needle assembly including a handle portion having a distal edge, and a plurality of needles associated with the handle portion and arranged in a spaced, selectively determined order adjacent to the distal edge. Each of the needles terminates in a needle tip which extends from the distal edge. At least one of the needle tips has predetermined and distinct operational and nonoperational positions, whereby the order of the needles may be effectively reconfigured by selectively positioning the needle tips in desired operational or nonoperational positions.

The assembly may further include a plurality of independent handle portions, wherein the independent handle portions each have means for detachably and selectively connecting adjacent individual handle portions. The order of the needle tips preferably may be rearranged by detaching at least one of the handle portions, repositioning the handle portion(s) in a different order, and reattaching the handle portion(s) in the new order. Alternatively, at least one of the needle tips may be movably mounted to the handle portion for altering the needle tip between the operational and nonoperational positions.

In a preferred embodiment, the assembly further comprises a hook assembly including a handle having a distal edge and a hook associated with the handle. Each hook terminates in a hook tip that extends from the distal edge. The assembly may further comprise a plurality of hook tips extending from the distal edge of the handle portion, with the hook tips being arranged in a spaced and selectively determined order. At least one of the hook tips preferably has predetermined and distinct operational and nonoperational positions, whereby the order of the hooks may be effectively reconfigured by selectively positioning the hook tips in desired operational or nonoperational positions.

Like the needle tips, the hook assembly may further include a plurality of individual handle portions, wherein the individual handle portions each have means for being detachably connected with adjacent independent handle portions. In such an embodiment, the hook tips of the assembly may be rearranged by disassembling the individual handle portions, either changing the order of the hook tips or adding or removing hook tips from the assembly, and reassembling the handle portions in the new order. Additionally, at least one of the hook tips also may be movably mounted to the handle portion for selectively altering the hook tip between an operational and nonoperational position as desired.

The assembly is designed for use within a system for producing knitted fabric, where the system preferably comprises a frame having a plurality of spaced prongs and the needle assembly having a plurality of needles associated with a handle portion. In addition, the system preferably includes the hook assembly for creating different types of stitches. Methods for producing patterned knitted fabric are provided which comprise the steps of changing the order of the needle and hook tips by selectively reconfiguring the assembly and/or switching at least one hook or needle tip between operational and nonoperation positions.

BRIEF DESCRIPTION OF THE DRAWINGS

While the specification concludes with claims particularly pointing out and distinctly claiming the present invention, it is believed the same will be better understood from the following description taken in conjunction with the accompanying drawings, in which:

DETAILED DESCRIPTION OF THE INVENTION

Figure 1:
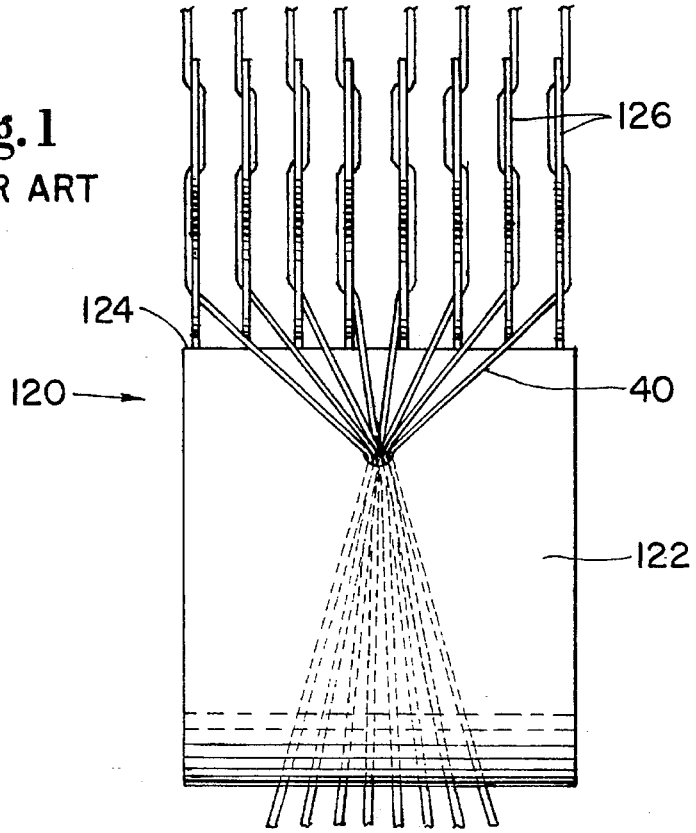
Fig. 1 PRIOR ART
FIG. 1 is a top plan view of a prior art needle assembly having a single handle portion in a plurality of fixed needle tips extending therefrom.

Referring now to the drawings in detail, wherein like numerals indicate the same elements throughout the views, FIG. 1 shows a top plan view of an exemplary needle assembly (120) of prior art which can be modified in accordance with the the present invention, including a handle portion (122) having a distal edge (124) and a plurality of needle tips (126) extending from distal edge (124). Although FIG. 1 shows eight needle tips (126) extending from handle (122) adjacent the distal edge (124), it should be understood that the number of needle tips (126) may vary such that a suitable number of needle tips may be determined by one skilled in the art according to the particular application.

Figure 2:
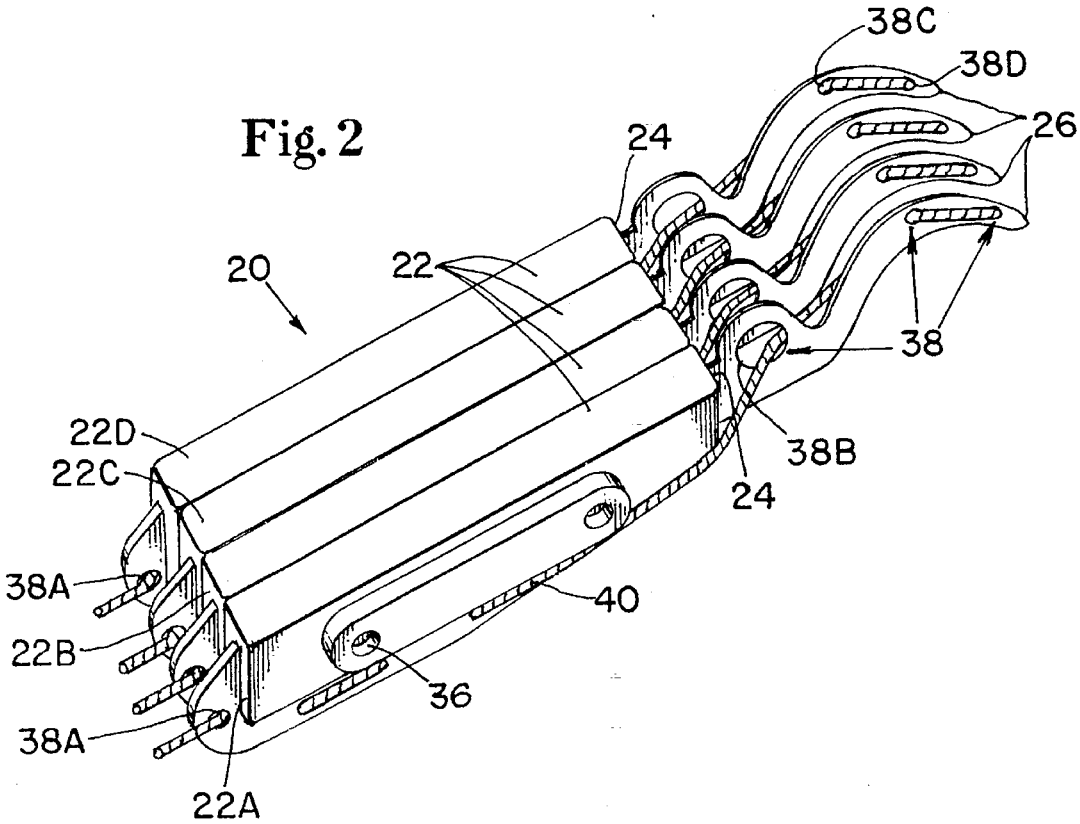
FIG. 2 is a perspective view of a needle assembly of the present invention comprising a plurality of needle tips and individual needle handles connected in a predetermined order.

FIG. 2 shows a preferred needle assembly of the present invention (20) having four independent handle portions (22A, 22B, 22C, 22D) connected together in accordance with the present invention. Although FIG. 2 shows an individual handle portion (22) for each needle tip (26), it is not necessary that each needle tip (26) have its own handle portion. As will be appreciated, any convenient number of needle tips (26) may be attached to each handle portion (22) as determined by those skilled in the art, so long as the order of such needle tips may be selectively arranged by the user to alter resulting stitches, as will be explained below. Each individual handle portion (22) has a distal edge (24) and at least one needle tip (26) which extends from the distal edge (24).

Figure 3:
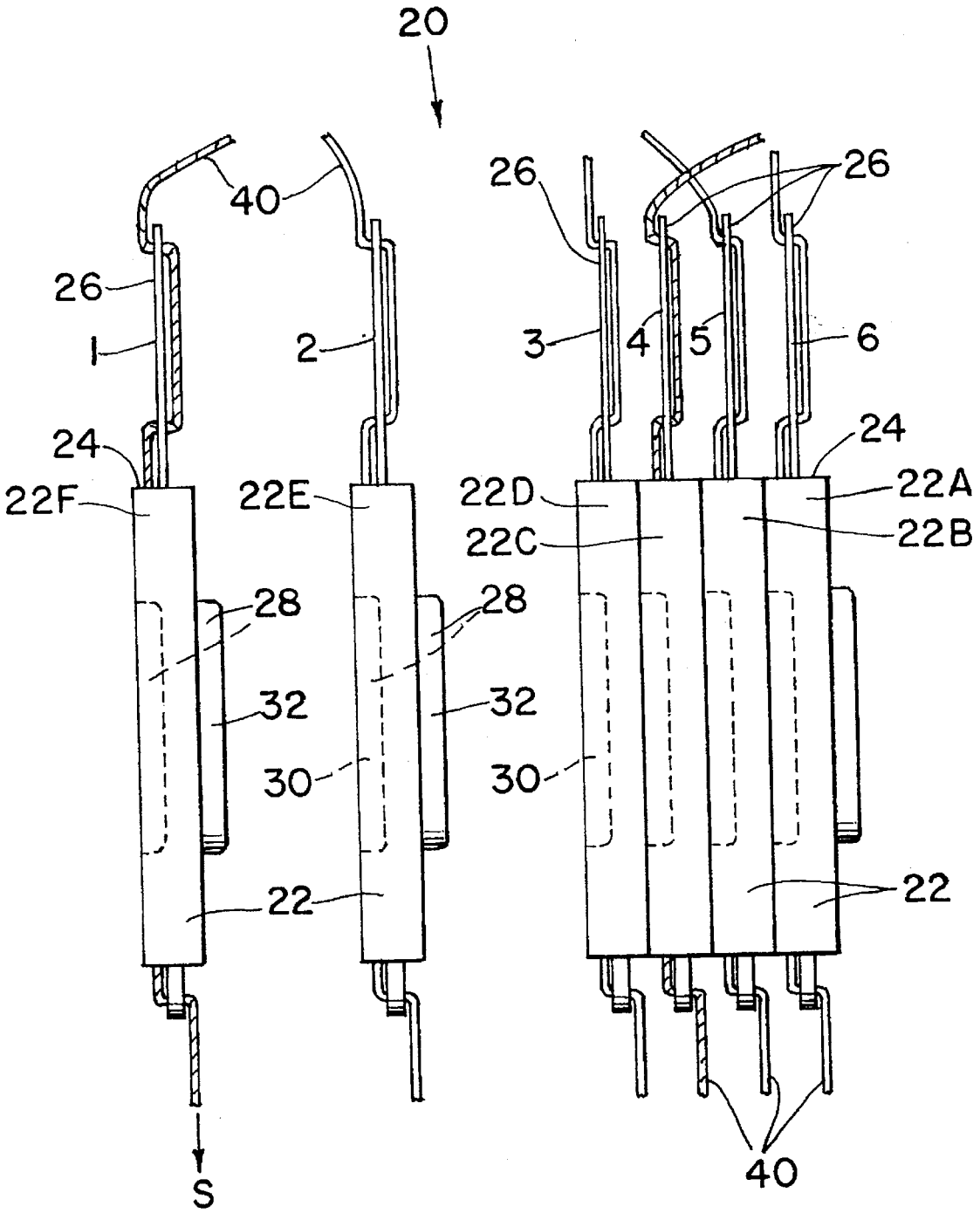
FIG. 3 is a top plan view of the needle assembly of FIG. 2 illustrating the attachment of additional needle tips.

FIG. 3 is a partially exploded top plan view of the needle assembly (20) showing two additional needles (22E and 22F) being added to assembly (20). One of the primary advantages of this invention is the ability to change the number and order of needle tips (26) in the needle assembly (20). Therefore, each handle portion (22) includes means (e.g. 28) for detachably connecting adjacent independent handle portions (22), wherein the connecting means (28) preferably includes corresponding interlocking portions or other corresponding quick-detach structure to facilitate convenient assembly and disassembly as desired. The interlocking portions of the independent handle portions (22) preferably can comprise an elongated recess (30) and a flange (32) which is sized for fitting into the recess (30) of the adjacent handle portion (22) when the handle portions are aligned adjacent one another.

Preferably, each independent handle portion (22) has a recess (30) and a flange (32) disposed on opposing sides so that the handle portions (22) may be aligned and securely interlocked. Preferably, each recess (30) further includes at least one post (34) disposed therein, and each flange (32) has at least one slot (36) disposed so as to receive the post (34) of an adjacent handle portion (22). Other snap-type, latch-type, or male/female interlocking arrangements could easily be substituted for this recess and flange combination. Having a plurality of needle tips (26) in one assembly (20), wherein the order of the needle tips (26) may be selectively changed, allows a user to knit more than one stitch at a time which expedites the garment making process, allows knitting of exclusive and new stitches, and simplifies knitting simultaneously with multiple colors of yarn material (40). The needle tips (26) may be as described in U.S. Pat. Nos. 4,246,768, 4,193,273, and 4,362,032 which are incorporated in their entirety by reference herein. Preferably, each needle tip (26) also has three spaced eyes (38) as described below and in U.S. Pat. No. 4,362,032. As will be appreciated, the order of needle tips (e.g. 1–6) as shown in FIG. 3 can be rearranged as desired by disassembling handle portions (22A–22F) and reassembling in the preferred interlocked order.

As shown in FIGS. 4A–D, the needle assembly (20) is to be used in conjunction with a frame (42) to make stitches with yarn material (40) from a yarn supply (S). The frame (42) has a plurality of spaced upstanding prongs (44) around which the yarn material (40) is stitched. The spacing between adjacent prongs (44) generally coincides with the spacing between adjacent needle tips (26), although every prong is not always utilized for each stitch. The yarn material (40) from a yarn material supply (not shown but indicated generally as (5) is threaded first through eye (38A)

(shown in FIG. 2) of handle portion (22) (as shown in FIG. 2), the yarn extending along the handle portion (22) and passing through eye (38B), which is located through the needle tip (26) adjacent distal edge (24), extending along needle tip (26), passing through eye (38C) which is located near a crest of the curved needle tip (26), and extending further along needle tip (26) and through eye (38D) so that it is provided for stitching onto the frame.

A single needle tip (26) of the needle assembly (20) is used to cast stitches onto the frame (42), generally starting at one edge or end of the frame. The yarn material (40) is knotted around a first prong (44), and the needle tip (26) is used to wind the yarn material (40) around each such prong that is being used. The number of prongs (44) used varies according to the garment that is being constructed, generally being higher for tighter stitches, lower for looser knit fabrics. Once stitches have been placed on all of the prongs being used, the needle tip (26) is then used to knit a second connected line of stitches beginning with the last prong (44) onto which the yarn material (40) was cast. FIGS. 4A–4D demonstrate how the basic knit stitch is created.

Figure 4A:
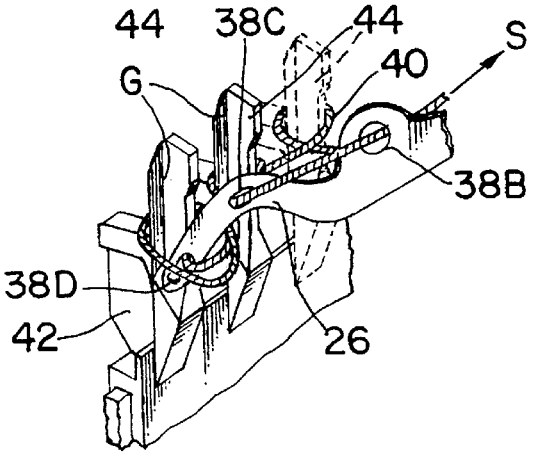
FIGS. 4A–4D are sequential illustrations showing the movement of the needle tip relative to a frame prong of the assembly when creating an exemplary basic knit stitch.
Figure 4B:
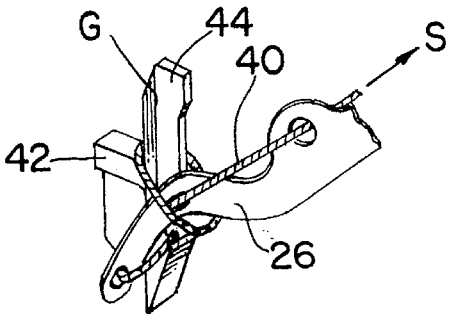
Figure 4C:
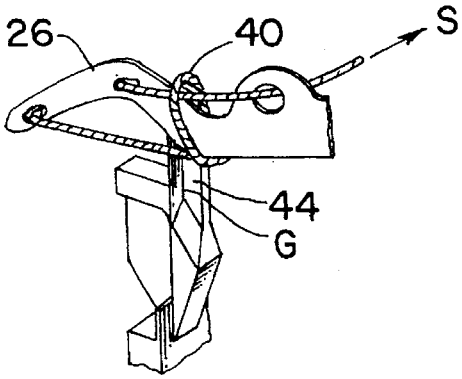
Figure 4D:
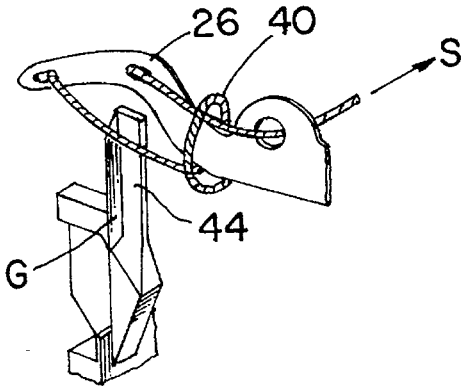

The first step, as shown in FIG. 4A, requires placing the threaded needle tip (26) at the left side of the prong (44) and sliding the needle tip (26) in the direction of the arrow into the loop of yarn material (40) which surrounds the prong (44). FIG. 4B illustrates the position of the needle tip (26) when inserted into the loop of yarn material (40), and, as illustrated in FIG. 4C, the loop is then lifted so that the yarn material (40) slips off of the prong (44) and rests on the needle tip (26). FIGS. 4D show how the needle tip (26) is then moved to the right side of the prong (44) and pulled back such that a new loop of yarn material (40) is formed around prong (44). This process is continued until the needle tip (26) reaches the opposite end of the frame (42).

The process is then repeated in the opposite direction (from right to left) beginning with the prong (44) on which the last stitch was knitted.

By employing more than one needle tip (26), the needle assembly (20) of this invention is extremely advantageous because it allows faster knitting (one row for each needle tip (26) used), knitting of exclusive and new stitches which cannot be made with a single needle tip (26), and simultaneous knitting with multiple colors of yarn material (40). A primary advantage of the preferred embodiment of this invention is the ability to initially use needle assembly (20) with a single needle tip (26) to first cast the stitches onto the frame (42), and then to attach one or more additional needle tips (26) to the needle assembly (20) to knit more than one row of stitches at a time. In order to attach additional needle tips (26) to the assembly (20), after the first stitch of a new row is made by the single needle tip (26), a second needle tip (26) is aligned with the first needle tip and its handle portion connection means (28) is attached to the corresponding connection means (28) of the handle portion of the first or original needle tip (26) which had been used to cast the stitches on the frame. The original needle tip (26), thereafter, stitches on the second prong while the added needle tip (26) stitches on the first prong, so that two rows of stitches are being made simultaneously. As many needle tips as desired may be added in this manner, however, it is preferred that the number of needle tips (26) not exceed the number of prongs (44) on the frame (42), because it would be unnecessary to have extra needle tips (26) during the knitting process.

When the needle assembly (20) reaches the end of the frame (42) during the stitching process, the needle tips (26) are moved consecutively beyond the last prong (44) of the frame (42) such that, for example, after the original needle tip (26) stitches on the last prong (44), the assembly (20) is progressively moved as if actually stitching, but only the added needle tip (26) actually stitches on the last prong (44). To begin stitching the next two rows, the added needle tip (26) stitches a second stitch at the last prong (44) that it just stitched on, then moves over to the second prong (44) and stitches on the second prong (44) while the original needle tip (26) stitches on the last prong (44). In this way, the overall knitting process is greatly speeded up in a simple and efficient manner.

Figure 5:
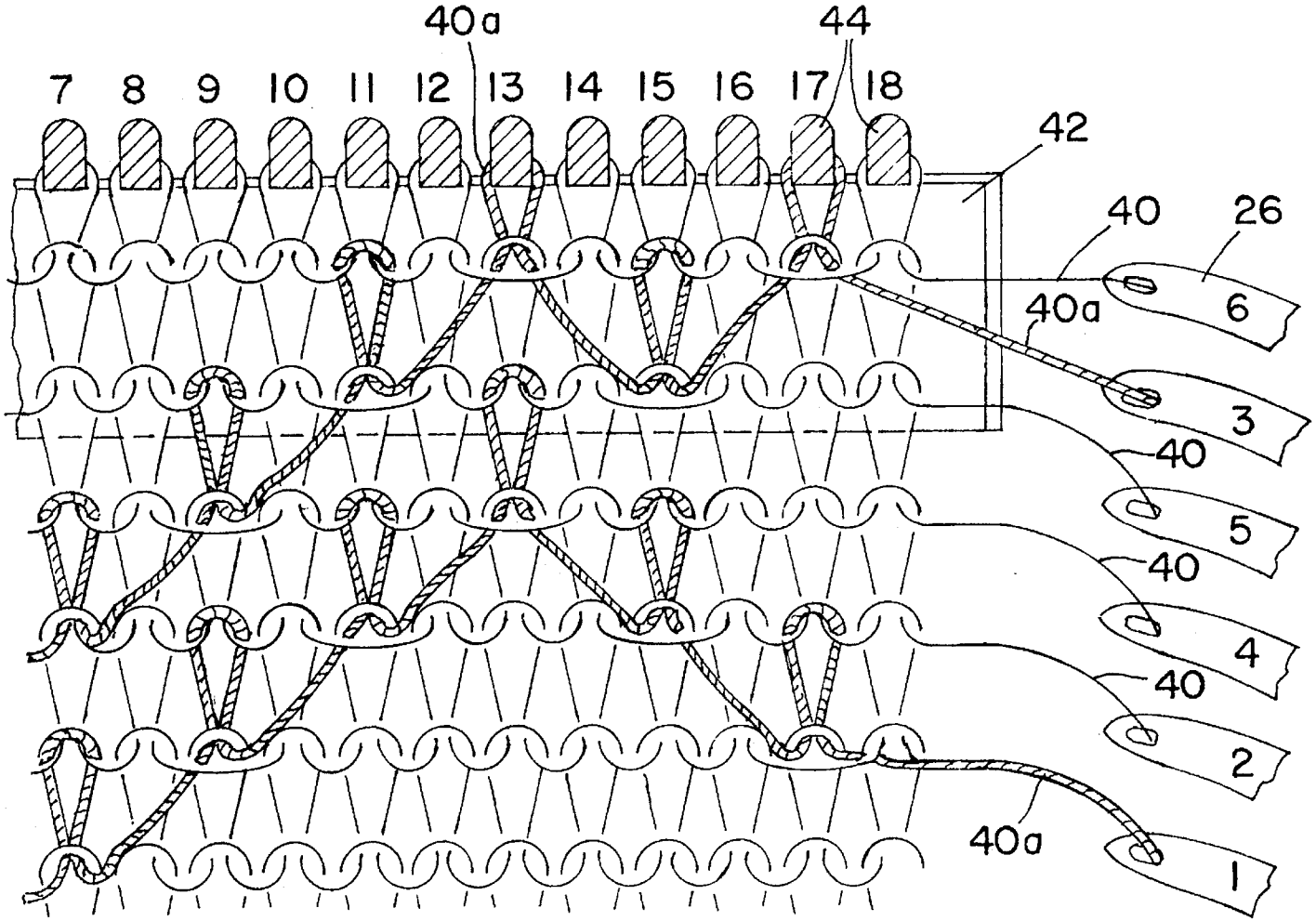
FIG. 5 is a partial front elevation view of a fabric being knit on a frame of the needle assembly of FIG. 3, wherein the six needle tips are numbered from 1 to 6.

New and exclusive stitches also may be created by interchanging various needle tips (26), or by skipping stitches to produce the desired pattern. For example a Jacquard or flame stitch can be produced by using the needle assembly (20) having six attached needle tips (26) (as best seen in FIG. 5), wherein the first and third needle tips (26) are threaded with a colored yarn material (40*a*) which is indicated by hatching, and the remaining needle tips (26) are threaded with white yarm material (40) of a different color (e.g. white). If fabric is knitted using this arrangement of needle tips (26), two colored stripes are then formed on a white background. The Jacquard stitch is created by disassembling the needle assembly (20) and changing the order of the needle tips (26) between stitches so that the colored yarn material (40*a*) of the first and third needle tips is crossed over the white yarn material (40).

By crisscrossing the yarn material (40 and 40*a*), the stitches of colored yarn material (40) are diagonally disposed on the white background which can be used to produce a Jacquard pattern. Other exclusive stitches can be created by skipping certain stitches in a row. Stitches can be skipped by disassembling the needle assembly (20) and removing one or more needle tips (26) from the assembly (20), or as will be discussed below, by moving one or more needle tips to their non-operative position. The remaining needle tips (26) are then used to stitch the next stitch.

Another arrangement for moving a needle tip to its non-operative position includes providing a rotatable connection (not shown) between adjacent handle portions (22) so that the "removed" needle tip can be rotated about its horizontal axis so that its needle tip (26) is not aligned with the other needle tips (26) in the assembly. The entire assembly (20), including the handle portion (22) of the nonoperational needle tip (26), is then used to knit. When the needle tip (26) is physically removed from the assembly (20), rather than moved in or out of operational position, the needle tips on either side of it must be used separately in order to skip that particular stitch. This slows the knitting process, especially if multiple needle tips are to be moved from operational position.

Figure 6:
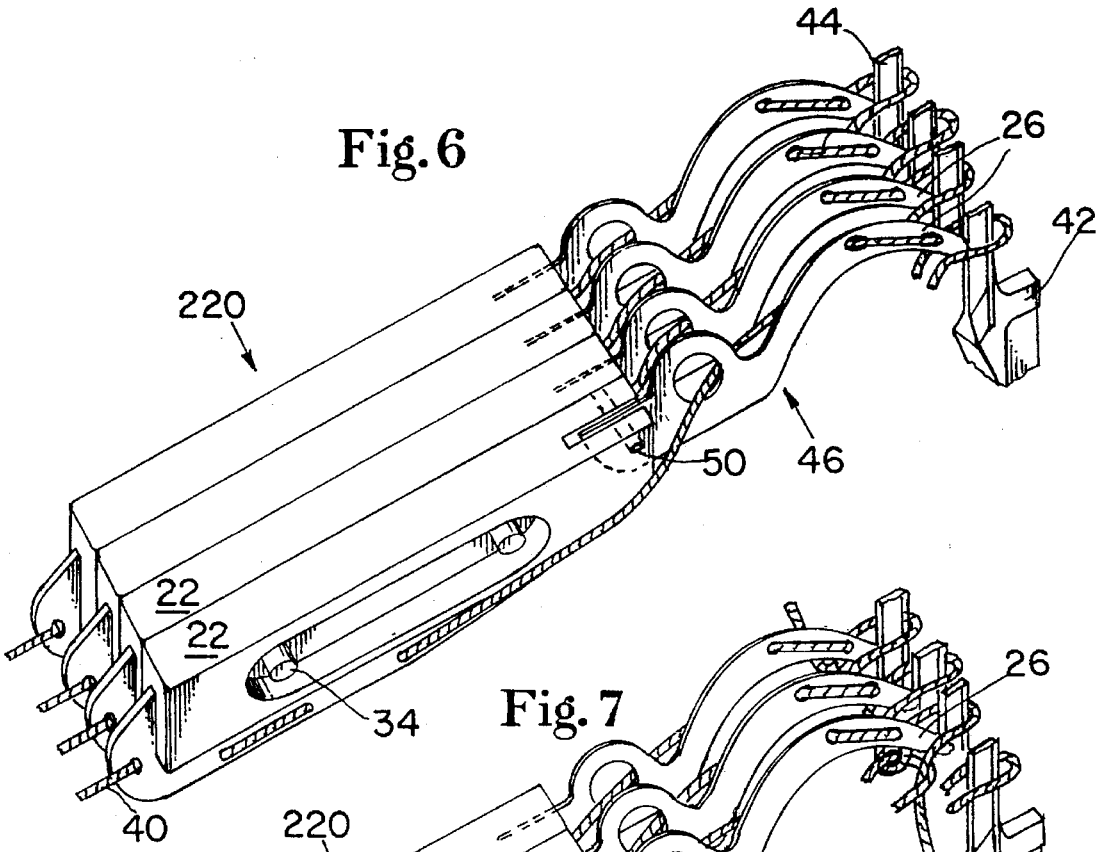
FIG. 6 is a perspective view of an alternative needle assembly of this invention which includes a movably mounted needle tip, and wherein all of the needle tips are illustrated in operational position.
Figure 7:
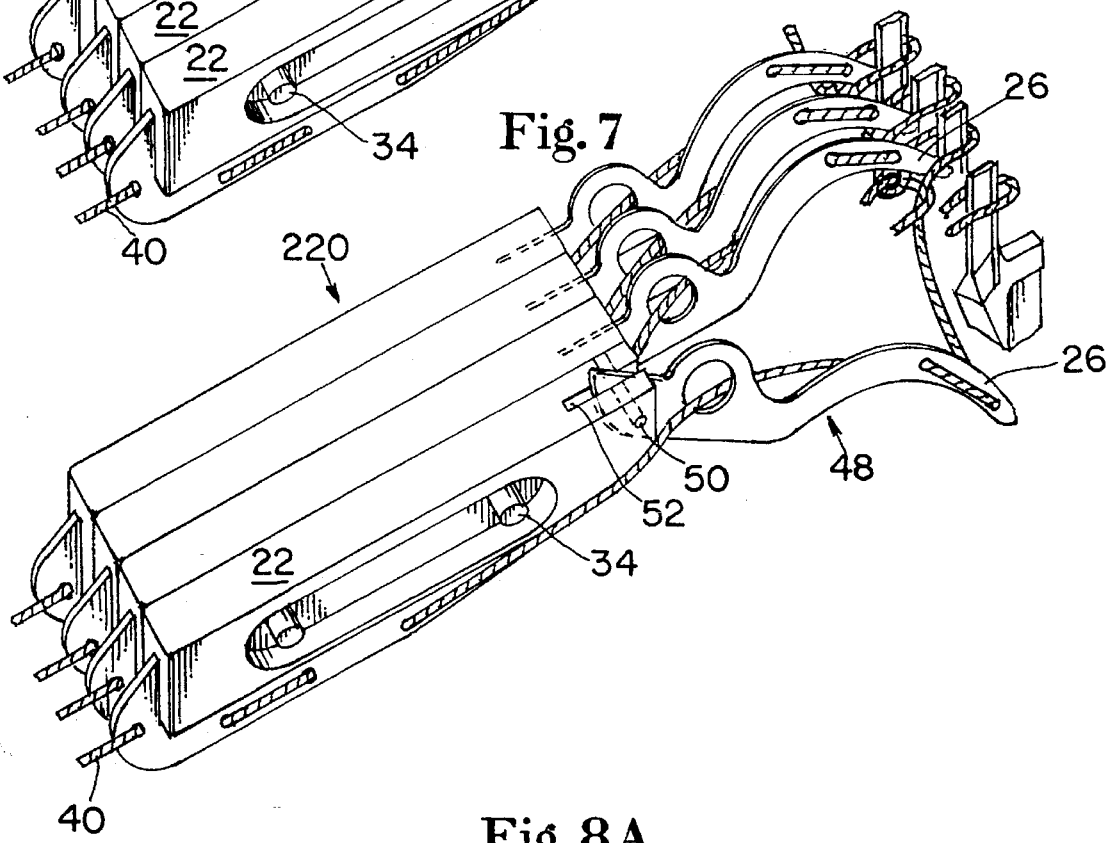
FIG. 7 is a perspective view of the needle assembly of FIG. 6 showing one of the needle tips in nonoperational position.

An alternative preferred embodiment of the present invention provides an easier method for changing the order of the needle tips (26), because the step of disassembling the needle assembly (20) is eliminated. This embodiment of the invention provides one or more of the needle tips (26) movably mounted to the distal edge (24) of the handle portion (22) of the needle assembly (220). As illustrated in FIGS. 6 and 7, the first needle tip (26) is movably mounted between an operational position (46) wherein the needle tip (26) is aligned with other needle tips for knitting, and a nonoperational position (48) wherein the needle tip (26) is not aligned with other needle tips for knitting. By moving the needle tip (26) into nonoperational position (48), the order of needle tips (26) is effectively changed for that stitch. The needle tip (26) may be movably mounted to the distal edge (24) by a means for selectively pivoting the needle tip

(26) between its two position. There are several suitable reciprocation means that may be determined by those skilled in the art; however, the preferred pivoting means comprises a hinge (50) and a slot (52) disposed within the handle portion (22). The slot (52) allows the needle tip to rotate about the hinge (50) between its operational (46) and nonoperational (48) positions.

Alternatively, a longitudinal sliding connection means may movably mount the needle tip (26) to the handle portion (22) such that the needle tip (26) can be longitudinally retracted rearwardly relative to distal edge (24) into a nonoperational position from its operational position. Another alternative means for movably mounting the needle tip (26) is to have the independent handle portions (22) rotatable relative to one another so that the entire needle tip (26) and corresponding handle portion (22) can be rotated between operational and non-operational positions. For example, a push button catch (not shown) could be released in the handle portion (22) of the needle assembly (20) to allow the handle portions (22) to rotate relative to one another. Once the needle tips (26) are in the desired positions, the catch would re-engage to lock the needle tip in one of the two positions. All of these embodiments of the needle assembly (20) are quicker and easier to use than manually interchanging the individual handle portions (22), however, interlocking independent handle portions (22) are most preferred, because they allow a user to select and vary the number of needle tips (26) which comprise the needle assembly (20).

Figure 8A:
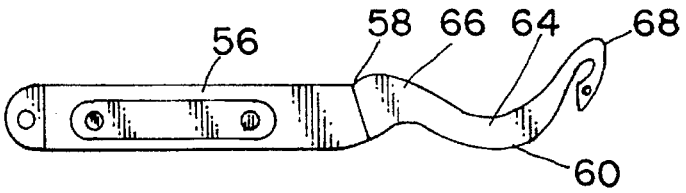
FIG. 8A is a side elevation view of an alternative embodiment of a single hook of the hook assembly of FIG. 8.
Figure 8:
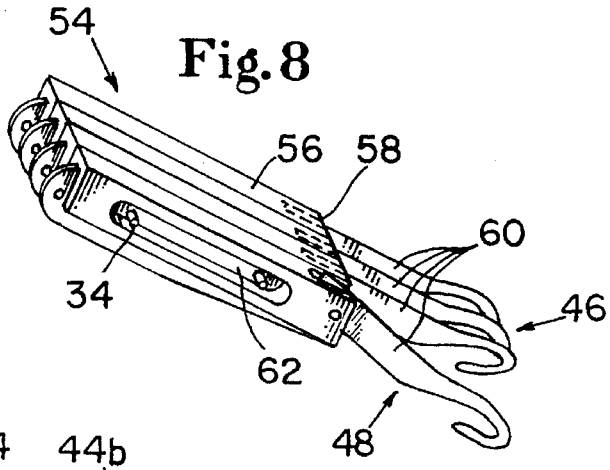
FIG. 8 is a perspective view of a hook assembly made in accordance with this invention.

The preferred embodiment of this invention further comprises a hook assembly that is used with the needle assembly and frame for creating additional stitches, such as purl stitches. Previously, the only knitting apparatus other than conventional knitting needles that was capable of knitting purl stitches was a knitting machine having two opposing needle beds. It is a significant advantage over the prior art that this invention can knit purl stitches easier and faster than conventional knitting needles, and yet, can be done at home instead of by commercial knitting machines. FIG. 8 illustrates a preferred hook assembly (54) of the present invention which includes a handle (56) with a distal edge (58) and at least one hook tip (60) that extends outwardly from the distal edge (58). Hook tip (60) has a generally planar and serpentine shape for retaining yarn material for stitching and facilitating easy release of the yarn material as desired. One embodiment of hook tip (60) has a more pronounced serpentine shape as shown in FIG. 8A wherein the hook tip (60) includes a concave portion disposed between, and continuous with, two convex members, a first convex portion (66) that is adjacent the distal edge (58), and a second convex portion (68) that is located at a free end of the hook tip (60). If a plurality of hook tips (60) are present, they can be arranged in a spaced and selectively determined order so that the hook assembly can be used in conjunction with a corresponding needle assembly (20). For example, if the needle assembly (20) employs six needle tips (26), then hook assembly (54) should similarly provide six hook tips (60). The spacing between hook tips (60) preferably also coincides with the spacing of the prongs (44) on the frame (42) and the spacing of the needle tips (26) of needle assembly (20). In a preferred embodiment, handle (56) comprises a plurality of handle portions (57), with each independent handle portion (57) having means (e.g. 62) for detachably connecting adjacent independent handle portions. The connecting means (62) preferably comprise corresponding interlocking portions of the handle portions similar to those described above for the needle assembly. Preferably, the interlocking portions of connecting means (62) include an elongated recess and a corresponding flange sized for interlocking connection with a recess of the adjacent independent handle portion. The recess further includes at least one post disposed within the recess and the flange further includes at least one slot for lockingly receiving the post of an adjacent independent handle portion in secure connected condition.

Figure 9A:
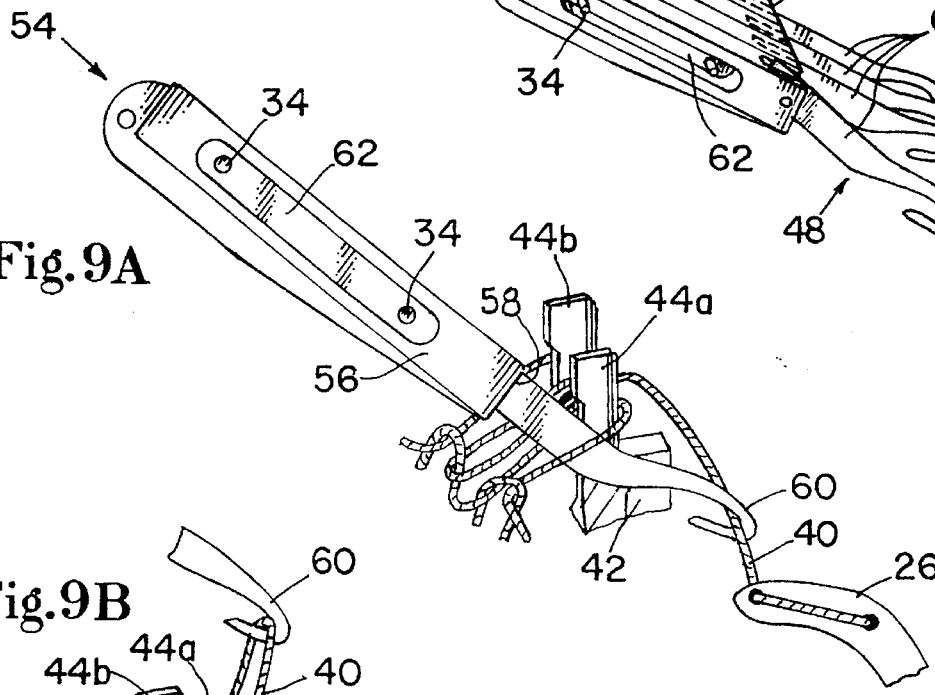
FIGS. 9A–D illustrate a sequence of views showing the steps of creating an exemplary purl stitch with the hook assembly of this invention.
Figure 9B:
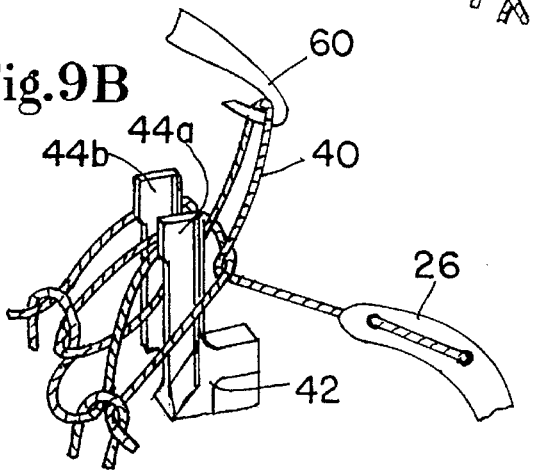
Figure 9C:
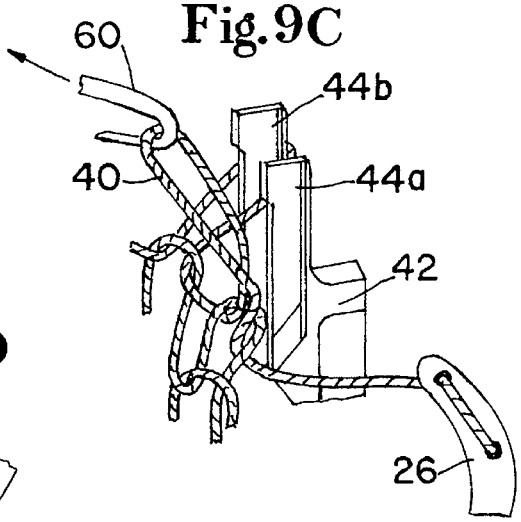
Figure 9D:
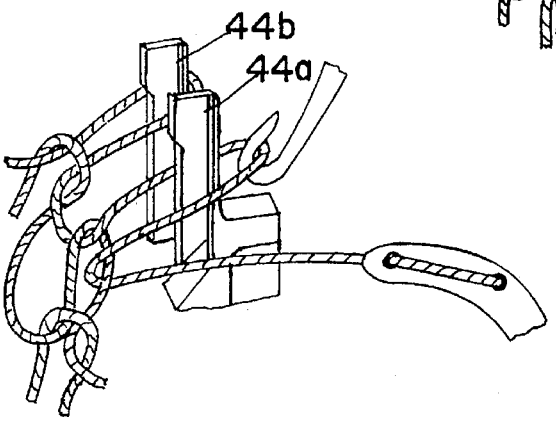

As illustrated in FIG. 9A, a purl stitch is created by introducing the hook tip (60) from the back of the frame (42) and inserting it down into the yarn loop on prong (44). The hook tip (60) catches the yarn material (40) extending between the corresponding needle tip (26) and the previous stitch on the frame (42). FIG. 9B shows how the hook tip (60) is then used to pull the yarn material (40), upwardly and backwards through the loop. As seen in FIG. C, the lifting action of the hook tip (60) lifts the loop off of the prong (44*a*), and as shown in FIG. 9D, the hook tip (60) is used to place the new loop over the prong (44*a*).

Like the needle assembly (20), the order of the hook tips (60) may be selectively changed by disassembling, interchanging or removing, and reassembling the individual handle portions of the hook assembly. However, the preferred embodiment of the hook assembly (54) includes movably mounting the hook tip (60) to the handle portion (56) for selectively reciprocating the hook tip (60) between operational (46) and nonoperational (48) positions. Preferably, the hook assembly (54) is substantially identical in structure to the needle assembly (220) except for the serpentine shape of the hook tip (60) and the absence of eyes.

As shown in FIG. 4A–D, each prong (44) has a groove (G) along each side for accommodating a needle or hook tip. The groove (G) is more fully described in U.S. Pat. Nos. 4,246,768 and 4,362,032 which have been incorporated by reference herein.

Having shown and described the preferred embodiments of the present invention, further adaptations of the knitting assembly and method shown and described herein can be accomplished by appropriate modifications by one of ordinary skill in the art without departing from the scope of the present invention. Several of these potential modifications have been mentioned, and others will be apparent to those skilled in the art. Accordingly, the scope of the present invention should be considered in terms of the following claims and is understood not to be limited to the details of structure and operation shown and described in the specification and drawings.

We claim:

1. A needle hook apparatus for use with a needle assembly for a knitting assembly for producing patterned knitted fabric, said needle hook comprising:

a handle having a distal edge;

and said needle hook terminating in a hook tip that extends from said distal edge, said hook tip having a generally planar and serpentine shape for retaining yarn material for stitching and facilitating easy release of the yarn material as desired and a free end for facilitating catching and release of yarn material.

2. The apparatus of claim 1, wherein said serpentine shape includes a concave portion disposed between, and continuous with, two convex portions, a first convex portion that is adjacent said distal edge, and a second convex portion that is located at a free end of said hook tip.

3. The apparatus of claim 2, wherein said second convex member substantially forms a loop having an opening for admitting and releasing the yarn material.

4. The needle hook apparatus of claim 1, further comprising a plurality of needle hook tips which can be moved relative to each other to enable arrangement of said hook tips in selectively determined spacing and order.

5. The needle hook apparatus of claim 4, further comprising a plurality of individual handle portions which are detachably connectable with adjacent handle portions to facilitate relative movement of said tips as desired.

6. The needle hook apparatus of claim 5, wherein said handle portions comprise corresponding interlocking flanges and recesses for selective and detachable connection to one another.

7. The needle hook apparatus of claim 4, wherein at least one of said needle hook tips has predetermined operational and non-operational positions.

8. A needle hook assembly comprising a plurality of handle portions having distal edges, and a plurality of needle hooks each terminating in a hook tip extending from a distal edge of a handle portion, said hook tips arranged in a spaced and selectively determined order adjacent one another, and at least one of said hook tips being moveable to enable selective reconfiguration of at least the order of adjacent hook tips.

9. The needle hook assembly of claim 8, wherein said handle portions are detachably connectable to one another.

10. The needle hook assembly of claim 9, wherein said handle portions comprise corresponding interlocking flanges and recesses for selective and detachable connection to one another.

11. The needle hook assembly of claim 8, wherein said at least one of said hook tips comprises predetermined operational and non-operational positions.

12. The needle hook assembly of claim 8, wherein said needle hook tips comprise a generally serpentine shape and a free end.

13. A needle hook knitting assembly for producing patterned knitted fabric, said assembly comprising:

a knitting frame having a plurality of spaced upstanding prongs;

at least one knitting needle for casting stitches onto the frame; and at least one needle hook apparatus further comprising a handle having a distal edge, and a needle hook terminating in a hook tip that extends from said distal edge and having a generally planar and serpentine shape, and said needle hook having a free end for facilitating catching and release of the yarn material.

14. The knitting assembly of claim 13, wherein said needle hook comprises a generally serpentine shape and having a convex member located adjacent said free end.

15. The knitting assembly of claim 13, further comprising a plurality of handle portions having distal edges, and a plurality of needle hooks each terminating in a hook tip that extends from a distal edge of a handle portion, said hook tips arranged in a spaced and selectively determined order adjacent one another, and at least one of said hook tips being moveable to enable selective reconfiguration of at least the order of adjacent hook tips.

16. The needle hook assembly of claim 15, wherein said handle portions are detachably connectable to one another.

17. The needle hook apparatus of claim 15, wherein said handle portions comprise corresponding interlocking flanges and recesses for selective and detachable connection to one another.

18. The needle hook assembly of claim 15, wherein said at least one of said hook tips comprises predetermined operational and non-operational positions.

19. A needle hook apparatus for use with a needle assembly for a knitting assembly for producing patterned knitted fabric, said needle hook comprising: a handle having a distal edge; and a plurality of needle hooks associated with said handle portion and arranged in a spaced, selectively determined order adjacent said distal edge, each needle hook terminating in a hook tip that extends from said distal edge, and having a generally planar and serpentine shape for retaining yarn material for stitching and facilitating easy release of the yarn material as desired, at least one of said needle hooks having predetermined and distinct operational and nonoperational positions, whereby the order of said needle hooks may be effectively reconfigured by selectively positioning said hook tips in desired operational or nonoperational positions.

* * * * *

UNITED STATES PATENT AND TRADEMARK OFFICE

CERTIFICATE OF CORRECTION

PATENT NO. : 5,577,400
DATED : Nov. 26, 1996
INVENTOR(S) : Walter Palange

It is certified that error appears in the above-indentified patent and that said Letters Patent is hereby corrected as shown below:

Column 10,

Claim 18, line 2, delete "predeternined" and insert therefor --predetermined--.

Signed and Sealed this

Fourth Day of March, 1997

*Attest:*

Bruce Lehman

BRUCE LEHMAN

*Attesting Officer*

*Commissioner of Patents and Trademarks*